US005484078A

United States Patent [19]

Bronovicki

[11] Patent Number: 5,484,078

[45] Date of Patent: Jan. 16, 1996

[54] CLOTHES HAMPER WITH ROTATABLE PARTITIONS AND INSERT THEREFORE

[75] Inventor: Raymond A. Bronovicki, Piscataway, N.J.

[73] Assignee: Marbac, Inc., Piscataway, N.J.

[21] Appl. No.: 55,246

[22] Filed: May 3, 1993

[51] Int. Cl.[6] ..... B65D 5/49

[52] U.S. Cl. ..... 220/531; 220/909; 220/528; 220/534; 220/557

[58] Field of Search ..... 16/366, 373, 386; 220/909, 531, 530, 528, 534, 557, 6, 7, 4.29; 229/198.1, 120.36

[56] References Cited

U.S. PATENT DOCUMENTS

| | | | |
|---|---|---|---|
| 2,806,623 | 9/1957 | Beckner | 220/6 |
| 2,893,007 | 7/1959 | De Windt | 16/373 |
| 2,895,782 | 7/1959 | Fragale . | |
| 3,301,582 | 1/1967 | Linecker . | |
| 3,720,346 | 3/1973 | Cypher | 220/909 |
| 4,012,090 | 3/1977 | Pfeifer et al. . | |
| 4,057,309 | 11/1977 | Fragale . | |
| 4,089,467 | 5/1978 | Makowicki | 16/386 |
| 4,389,133 | 6/1983 | Oberst . | |
| 4,463,895 | 8/1984 | Pasquale | 229/198.1 |
| 4,496,263 | 1/1985 | Laarhoven . | |
| 4,565,465 | 1/1986 | Oberst . | |
| 4,569,564 | 2/1986 | Ahmann . | |
| 4,621,877 | 11/1986 | Bourdreau et al. . | |
| 4,673,087 | 6/1987 | Webb | 220/4.29 |
| 4,955,502 | 9/1990 | Sorci | 220/528 |

FOREIGN PATENT DOCUMENTS

| | | | |
|---|---|---|---|
| 469704 | 11/1950 | Canada | 220/528 |
| 901657 | 8/1945 | France | 16/373 |
| 713445 | 9/1966 | Italy . | |
| 362512 | 12/1931 | United Kingdom | 220/557 |
| 2127780 | 4/1984 | United Kingdom | 220/528 |

OTHER PUBLICATIONS

Abstract for Soviet Union patent 1,364,559, Jan. 1988.

*Primary Examiner*—Stephen J. Castellano
*Attorney, Agent, or Firm*—Omri M. Behr; Matthew J. McDonald

[57] ABSTRACT

A clothes hamper includes rotatable partition walls which divide the hamper into subcompartments of differing capacities according to the amount of clothing in that subcompartment. A conventional hamper may be divided with a free standing insert placed in the hamper compartment and comprising a rear wall to which one or more partition walls are rotatably secured. The insert comprises thermoplastic corrugated sheets having longitudinal cells. A U-shaped wire hinge is inserted in a corresponding cell at opposing ends of the partition wall and rear wall, the hinge having bulbus thermoplastic ends for interference fit with the corrugation cell walls to frictional and rotatably secure the legs of the hinge in place.

6 Claims, 3 Drawing Sheets

CLOTHES HAMPER WITH ROTATABLE PARTITIONS AND INSERT THEREFORE

FIELD OF THE INVENTION

This invention relates to hampers and more particularly to hampers with divided compartments.

BACKGROUND OF THE INVENTION

Hampers are typically used to store soiled clothing for accumulation for subsequent cleaning. Clothing, however, comprises a wide assortment of materials having different cleaning attributes and methods. Clothing needs to be sorted prior to cleaning, typically, washing. Usually this task is unpleasant and tedious in that the soiled clothing needs to be piled into separate piles one item of clothing at a time. The problem is that most hampers in use have one volume into which clothing is placed.

Some hampers deal with this problem by providing a dividable hamper as illustrated for example in U.S. Pat. No. 2,895,782. Here, dividers are provided for dividing the hamper compartment into different subcompartments for sorting clothing. However, this is of no avail to one in possession of a clothes hamper without such dividers. Further, to change the subcompartment volumes in the patented hamper, the dividers need to be removed and reinserted. This is cumbersome if one of the subcompartments is full and the others are only partially full and there is a need to insert further clothing into the full subcompartment.

The present inventor recognizes a need for a hamper which addresses these problems in a simple and convenient low cost manner.

SUMMARY OF THE INVENTION

A hamper according the present inventions comprises a clothes storage bin having a compartment in which to store clothing and settable partition means located in the compartment and hinged relative to the bin for rotatable selective placement into different positions in said compartment for dividing the compartment into a plurality of subcompartments whose volumes are set to different values according to the relative placement of the partition means in said compartment.

In accordance with an embodiment of the present invention the partition means includes a first wall adapted to be inserted into the compartment and at least one second wall is hinged to the first wall so as to extend away from the first wall in different selected angular positions relative to the first wall.

In accordance with a further embodiment of the present invention, the partition means walls comprise corrugated sheet material in which at least one central corrugation material is sandwiched between two planar sheets to form a plurality of cells in each of the walls, the partition means include a hinge comprising a U-shaped member having opposing ends, each end including corrugation gripping means secured thereto and dimensioned to be inserted in at least one cell in interference fit with the walls of the at least one cell.

The term "corrugated" will be used herein as it represents a term generally understood in the art associated with corrugated cardboard. In the preferred embodiment of this invention the "corrugated" material is an extruded thermoplastic material rather than a tripartite cardboard composite having a central segment of continuous "S" shaped cross section glued between two planar cardboard sheets. The extruded plastic wall material of choice, when viewed in cross section has a very similar aspect to that of corrugated cardboard but comprises a plurality of individual separators forming together a plurality of elongated cells whose effect in use is similar to that of corrugated cardboard but whose wall strength is substantially greater.

IN THE DRAWING

DESCRIPTION OF THE PREFERRED EMBODIMENTS

Figure 1:
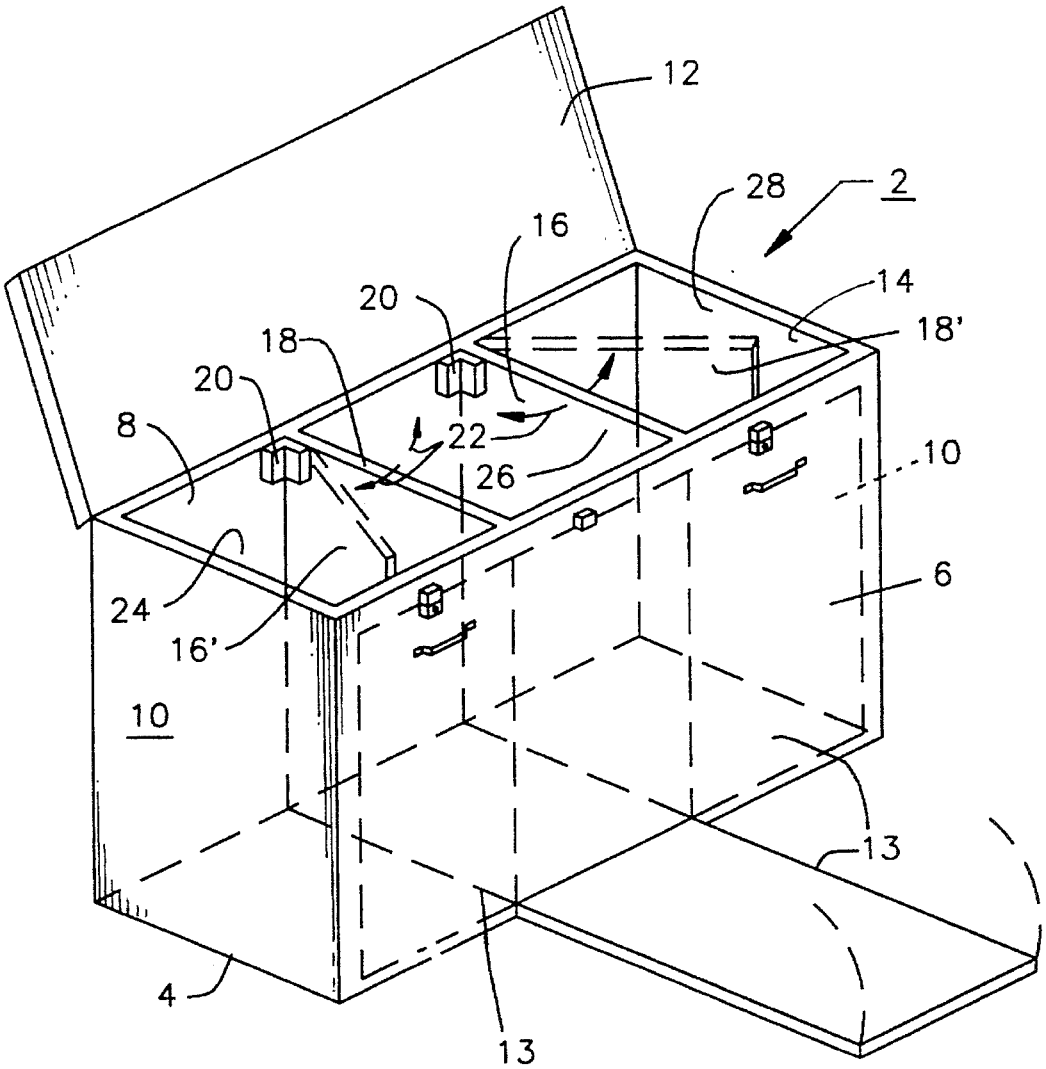
FIG. 1 is an isometric view of a clothes hamper according to one embodiment of the present invention.

In FIG. 1, clothes hamper 2 comprises a bottom wall 4, a front wall 6, a rear wall 8 and opposing side walls 10. A cover 12 is hinged to rear wall to cover the compartment 14 formed by the walls. The hamper is shown with planar side walls but these could be curved or other shapes according to a given implementation. The hamper may optionally have front doors 13, shown in phantom in the alternative to cover 12.

A pair of partition walls 16 and 18 of like dimensions and formed as planar sheets are each hinged to the rear wall 8 by hinges 20 only one for each partition wall being shown. The hinges are at the top and bottom of the walls or at any suitable location. The partition walls 16 and 18 may be formed of any suitable sheet material but are preferably "corrugated" extruded thermoplastic sheet material. The walls 16 and 18 are free to rotate in the direction of arrows 22. The walls 16 and 18 divide the compartment 14 into subcompartments 24, 26 and 28.

The volume of the subcompartments 24, 26 and 28 is determined by the rotated position of the walls 16 and 16. The position of the walls can be preset or not as desired. If it is known in advance, for example, that a need is required for one subcompartment to be larger than the others than one or both of walls 16 and 18 can be rotated as shown in phantom to a position at 16' and 18', respectively. In these positions the central subcompartment 26 is greatly enlarged as compared to the other subcompartments. Other arrangements of the walls 16 and 18 for providing a large variety of subcompartment volumes is readily apparent.

In the alternative to presetting the walls 16 and 18, they may be easily positioned as in solid line to form equal volume subcompartments. As the clothing is filled in the compartments, that subcompartment receiving more clothes will cause its partition wall to shift in position, presuming no or little clothing in the next adjacent compartment, automatically enlarging that subcompartment. Even if filled somewhat, the next adjacent compartment clothing can be easily manually manipulated so as to permit the wall 18, for example, to be rotated to enlarge either compartment 24 or 26 as needed.

Figure 2:
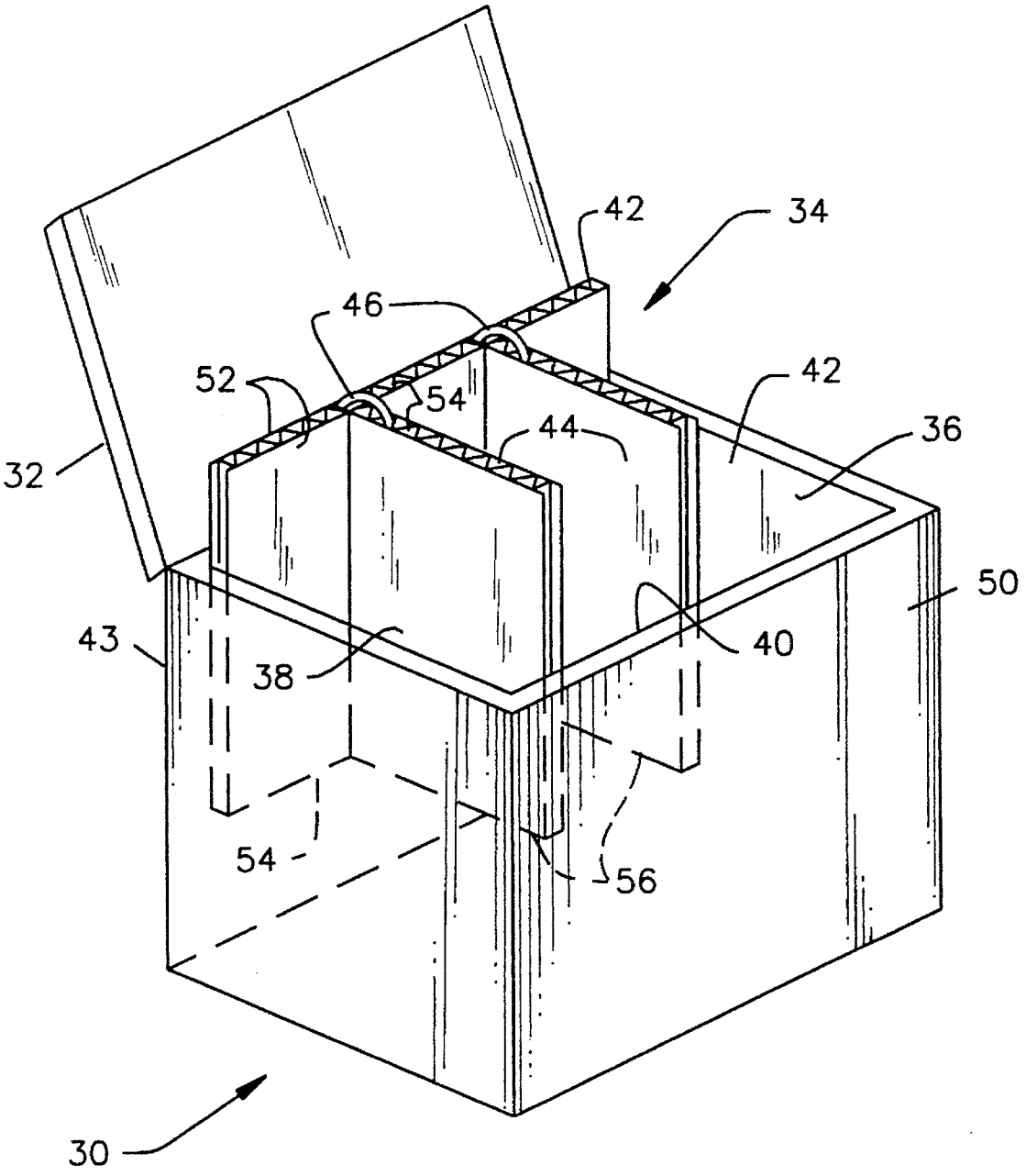
FIG. 2 is an isometric exploded view of a hamper according to a second embodiment of the present invention.

FIG. 2, hamper 30 forms a rectangular volume having a hinged cover 32. An insert 34 is inserted into the compartment 36 of hamper 30 to divide the compartment 36 into three subcompartments 38, 40 and 42. The hamper 30 with compartment 36 is conventional.

The insert 34 functions similarly as the partition walls 16 and 18 of the embodiment of FIG. 1.

Insert 34 comprises a rear wall 42 which abuts rear wall 43 of the hamper 30. Two like partition walls 44 are hinged to wall 42 in spaced relation by hinges 46, a hinge being located at the top and bottom of each wall. The walls 44 extend from the wall 42 to the hamper front wall 50 dividing the hamper compartment 36 into the subcompartments. The walls 42 and 44 are preferably formed of the same thermoplastic corrugated sheet material. This sheet material is formed from external thermoplastic skin layers 52 and thermoplastic separators 54 between layers 52. The multicellular effect of the separators 54 between layers 52 simulates corrugation.

Of course the walls 42 and 44 may comprise other materials including paper board material, solid or corrugated. If paper board, the material need be finished with a moisture impervious layer, e.g., wax, to protect the walls from damage due to wet clothing. The insert 34 is free standing on the bottom wall 45 of the hamper 30. That is, the walls 42 and 44 have bottom edges 54 and 56, respectively, which lie in plane to rest on the planar hamper 30 bottom wall 45. The bottom edges need not be linear, however, as they may include projections (not shown) forming feet on which to rest on the bottom wall 45.

Figure 3:
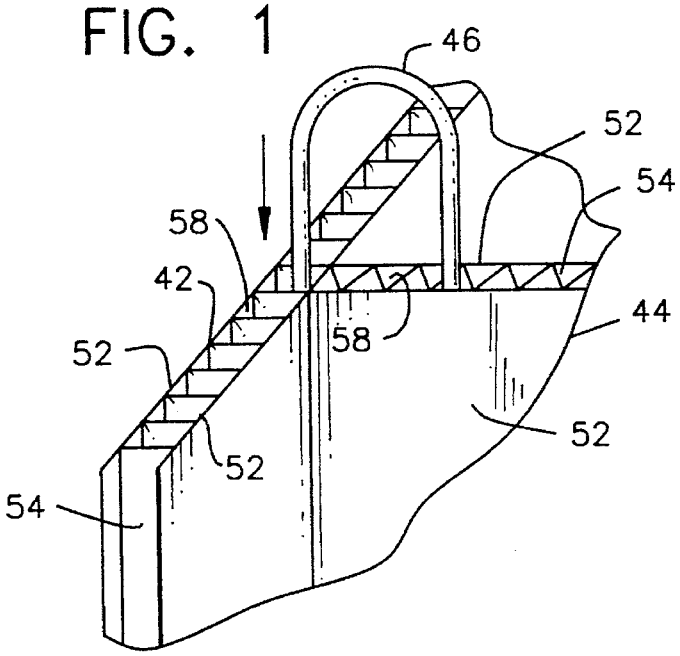
FIG. 3 is a more detailed isometric fragmented exploded view of a portion of the hinge portion of the embodiment of FIG. 2.
Figure 4:
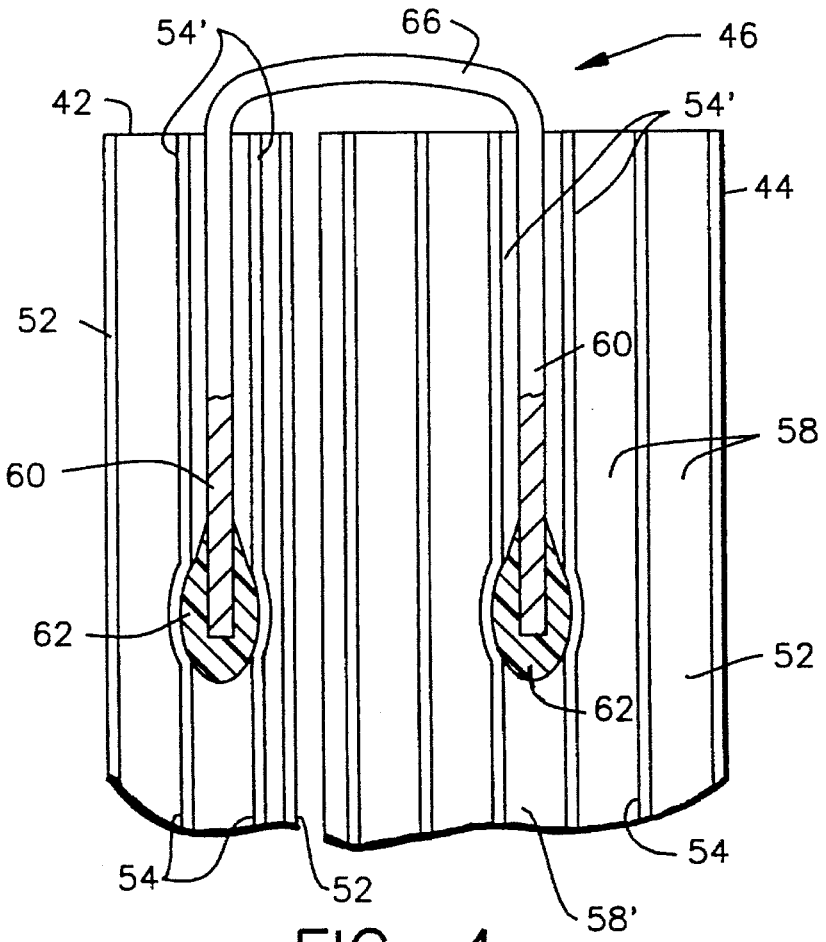
FIG. 4 is a sectional fragmented more detailed view of the hinge portion of the embodiment of FIG. 2 in accordance with one hinge embodiment.
Figure 6:
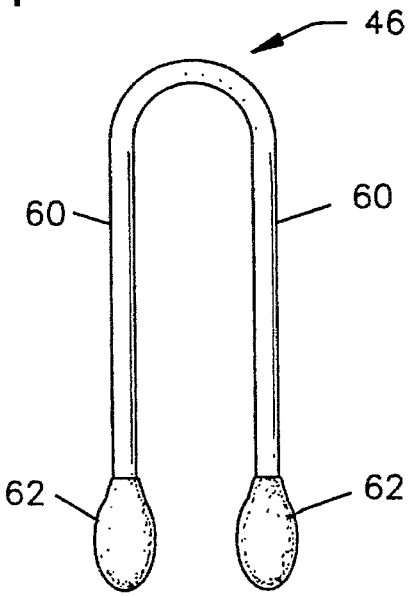
FIG. 6 is a side elevation view of the hinge of FIG. 4.

In FIGS. 3 and 4, the corrugations 54 comprise transverse planar members connected to and between skin layers 52. The corrugations form vertical cells 58 which extend for the height of the walls 42 and 44. Hinge 46, FIGS. 4 and 6, which is used to attach a wall 44 to wall 42 at the upper and bottom edges thereof comprises a U-shaped spring wire, e.g., 0.062 inch diameter spring steel. In this example, the corrugations may have an external thickness of about ⅛ inches and formed from sheet material of about 0.013 to about 0.015 mm thick thermoplastic. The legs 60 of the hinge 46 extend for several inches and are spaced apart about 0.5 to about 1.5, suitably less than 1.0 inches. The ends of the legs 60 include a gripping member 62 formed of a bulbous thermoplastic or rubber material. The member 62 has a transverse dimension greater than the spacing of the side walls of the cells 58 so as to resiliently expand these cell walls when inserted therebetween. This is seen in FIG. 4.

This action provides resilient friction engagement which locks the hinge in place axially but permits the associated walls to rotate relative thereto. A bend 66 in the hinge couples the legs 62. The bend may be curved, circular or any other shape. This provides a relatively low cost and simple construction.

Figure 5:
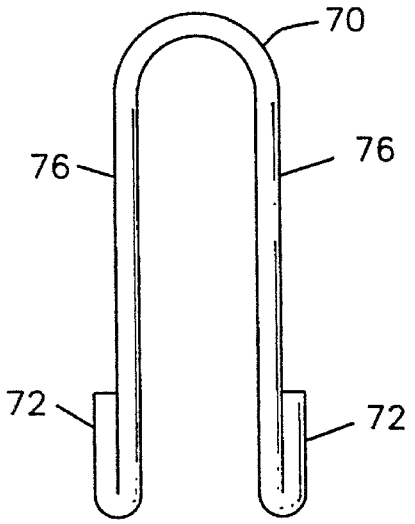
FIG. 5 is a side elevation view of a third embodiment of a hinge used with the embodiment of FIG. 2.

In FIG. 5, an alternate embodiment of a hinge 70 which may be used with the insert 34, FIG. 2, is shown and comprises a U-shaped spring with folded over bent ends 72 which form a doubled thickness of wire at the ends. The thicker ends serve a similar function as the gripping member 62 of the hinge 46 to compress in interference fit the adjacent corrugation cell walls to provide a frictional engagement which permits rotation of the attached walls about the corresponding hinge leg 76.

While preferred embodiments have been illustrated, it will occur to those of ordinary skill that various modifications may be made. It is intended that such modifications which come within the scope of the appended claims be included in the present invention.

What is claimed is:

1. A clothes hamper comprising a clothes storage bin having a bottom wall and a plurality of upstanding side walls defining a compartment in which to store clothing; and settable partition means hingedly affixed in said compartment for rotatable selective placement into a variety of constant positions in said compartment, which settable partition means may divide the compartment into a plurality of subcompartments, the volumes of which may be set to different values according to the relative placement of the partition means in said compartment, said settable partition means comprising a first wall in said compartment, said first wall having a rear surface confronting one of said upstanding side walls of said bin and a front surface facing outward into said compartment; and at least one partition wall having a first and a second end and a first and second side, said first end being hingedly affixed to said front surface of the first wall, and said second and being freely rotatable through said compartment about said first end, said at least one partition wall being dimensioned to extend away from said front surface of said first wall sufficiently to divide said compartment into a plurality of variable subcompartments, the volume of each subcompartment being variable according to the rotated position of said second end of said partition wall relative to said first wall.

2. The hamper of claim 1 wherein the walls are corrugated planar sheet thermoplastic material.

3. The hamper of claim 1 wherein each of said walls comprise corrugated sheet material in which at least one central corrugation material is sandwiched between two planar sheets to form a plurality of cells in each of the walls, said partition means including a hinge comprising an elongated U-shaped piece having opposing ends, each and including corrugation gripping means secured thereto and dimensioned to be inserted in at least one cell in interference fit with the walls of said at least one cell.

4. The hamper of claim 3 wherein the hinge is a wire and the gripping means comprises bulbous thermoplastic projection, said cells each having a given transverse dimension, said gripping means having a transverse dimension greater than said cell transverse dimension for resiliently displacing the walls of the at least one cell.

5. The clothes hamper of claim 3 wherein said first wall has a rear surface adjacent to and touching one of said upstanding walls of said bin;

a hinge rotatably joining said first end of said at least one partition wall to said front surface of said first wall; and where said first side of said at least one partition wall and said front surface of said first wall of said partition means define an angle which varies as said second end of said at least one partition wall is rotatably positioned about said hinge with respect to said first wall, said angle being approximately from 0° to 180°.

6. A clothes hamper comprising:

a clothes storage bin comprising a bottom wall, a top wall and a plurality of upstanding side walls forming a compartment in which to store clothing;

means for rotatably securing one of said top and side walls to the others of said walls for providing access to said compartment; and settable partition means located in said compartment and hinged relative to said bin for rotatable selective placement into different positions in said compartment for dividing the compartment into a plurality of subcompartments whose volumes are set to different values according to the relative placement of the partition means in said compartment;

said settable partition means comprising at least two walls hinged to each other for rotation relative to each other and dimensioned to be inserted into said compartment for dividing the compartment into at least two subcompartments for selectively setting the volumes of the subcompartments according to the hinged position of said at least two walls;

and further wherein the at least two walls of said settable partition means are corrugated thermoplastic material having a plurality of vertical cells, said settable partition means further including a hinge comprising a U-shaped wire having a corrugation gripping member at each end, each gripping member being dimensioned to fit in a corresponding corrugation vertical cell in interference fit.

* * * * *